US012103814B2

(12) United States Patent
Hagiwara

(10) Patent No.: US 12,103,814 B2
(45) Date of Patent: Oct. 1, 2024

(54) TAPE WINDER

(71) Applicant: Koji Hagiwara, Hyogo (JP)

(72) Inventor: Koji Hagiwara, Hyogo (JP)

( * ) Notice: Subject to any disclaimer, the term of this patent is extended or adjusted under 35 U.S.C. 154(b) by 360 days.

(21) Appl. No.: 17/617,381

(22) PCT Filed: Jun. 28, 2019

(86) PCT No.: PCT/JP2019/025821
§ 371 (c)(1),
(2) Date: Dec. 8, 2021

(87) PCT Pub. No.: WO2020/261535
PCT Pub. Date: Dec. 30, 2020

(65) Prior Publication Data

US 2022/0242690 A1 Aug. 4, 2022

(51) Int. Cl.
*B65H 81/08* (2006.01)

(52) U.S. Cl.
CPC ..... *B65H 81/08* (2013.01); *B65H 2404/511* (2013.01)

(58) Field of Classification Search
CPC .. B65H 81/06; B65H 81/08; B65H 2404/511; H01B 13/01281
See application file for complete search history.

(56) References Cited

U.S. PATENT DOCUMENTS 2,027,704 A * 1/1936 Rosener ..... B65H 81/08 156/392
2,657,866 A * 11/1953 Lungstrom ..... H01B 13/0825 242/422.4

(Continued)

FOREIGN PATENT DOCUMENTS

BR P10807342 A2 5/2014
CN 203372933 U 1/2014

(Continued)

OTHER PUBLICATIONS

Teng Teng, Design and Simulation of Automatic Tape Winding System, A Thesis presented to the Faculty of the Graduate School, University of Missouri-Columbia, Dec. 2018, Chapter 1 Introduction, p. 6 Link: https://mospace.umsystem.edu/xmlui/bitstream/handle/10355/67628/tengtengResearch.pdf?sequence=1&isAllowed=y.

(Continued)

*Primary Examiner* — Sang K Kim
(74) *Attorney, Agent, or Firm* — Rivka Friedman

(57) ABSTRACT

A roll tape 1 is held by a tip end portion of an arm 3 connected by a pivot shaft 4 fixed to a rotating body 5, and an enlarged diameter curved surface portion 6 is provided that comes into contact with the arm 3 that pivots at a time of rotation. In an angle range in which the arm 3 is in contact with the enlarged diameter curved surface portion 6, the arm 3 is pushed in a rotation outward direction at the time of rotation such that the tape stretched from the roll tape 1 to an object 9 is wound around the object 9 while being pulled out. In an angle range in which the arm 3 is not in contact with the enlarged diameter curved surface portion 6, the tape previously pulled out from the roll tape 1 is wound around the object 9 while being wound up on the object 9. By repeating this alternately, displacement of the object from the rotation axis is suppressed, and proper winding is performed.

6 Claims, 3 Drawing Sheets

(56) References Cited

U.S. PATENT DOCUMENTS

| | | | | | |
|---|---|---|---|---|---|
| 3,311,317 | A | | 3/1967 | Nichols et al. | |
| 3,395,870 | A | | 8/1968 | Klinger | |
| 3,420,722 | A | * | 1/1969 | M-Nee | B29C 63/105 138/144 |
| 3,486,317 | A | * | 12/1969 | Untz | B65H 81/08 242/421.8 |
| 4,008,114 | A | * | 2/1977 | Lindsey | B65H 81/08 156/392 |
| 4,069,088 | A | * | 1/1978 | Cottam | B65H 81/08 156/392 |
| 4,230,520 | A | | 10/1980 | Morgan | |
| 4,610,403 | A | * | 9/1986 | Goekler | B65B 11/008 156/428 |
| 4,725,009 | A | | 2/1988 | Fahrbach | |
| 4,778,119 | A | | 10/1988 | Yamazaki et al. | |
| 4,878,628 | A | | 11/1989 | Takeda et al. | |
| 6,854,683 | B2 | | 2/2005 | Hayashi et al. | |
| 7,520,120 | B2 | | 4/2009 | Saito et al. | |
| 2004/0129818 | A1 | | 7/2004 | Sugawara et al. | |
| 2007/0262189 | A1 | | 11/2007 | Kubota | |
| 2007/0262190 | A1 | | 11/2007 | Kubota | |
| 2011/0094097 | A1 | | 4/2011 | Saito et al. | |

FOREIGN PATENT DOCUMENTS

| | | | |
|---|---|---|---|
| CN | 104827650 | B | 8/2015 |
| CN | 105119185 | A | 12/2015 |
| EP | 0119390 | B1 | 4/1987 |
| JP | H06124614 | A | 5/1994 |
| JP | 2001206643 | A | 7/2001 |
| JP | 3649182 | B2 | 5/2005 |
| WO | 2005008689 | A1 | 1/2005 |
| WO | 2006133024 | A2 | 12/2006 |

OTHER PUBLICATIONS

Coll Winding Machine China, "Features" Section, 1st page of PDF. Link: https://www.coilwindingmachinechina.com/showroom/automatic-linear-tape-winding-machine-for-turbo-generator-coil.html.

Yao-Yao Shi et al., Development of a NC Tape Winding Machine, Section 2. "Analysis of the Processing Parameters", p. 2 Link: https://link.springer.com/chapter/10.1007/978-1-84800-239-5_74.

Bo Deng et al., Multi-Response Parameter Interval Sensitivity andOptimization for the Composite Tape Winding Process, Section 2.1. "Composite Prepreg Tape Winding Process", p. 3 Link: https://www.mdpi.com/1996-1944/11/2/220.

* cited by examiner (a)

(b)

TAPE WINDER

TECHNICAL FIELD

The present invention relates to a tape winder that winds a roll tape around an object such as a bundle of electric wires.

BACKGROUND ART

As a part of manufacturing of wire harnesses for a vehicle, a tape winding device has been proposed that winds a tape around a bundle of electric wires or an exterior member covering the bundle. In a tape winder included in the tape winding device, a tape supported by a rotating body that rotates in a plane intersecting the object at a right angle rotates around the object extended on the rotation axis so that the tape is wound around the object.

RELATED ART DOCUMENTS

Patent Document

Patent Document 1: Japanese Unexamined Patent Application Publication No. 2015-224123

SUMMARY OF THE INVENTION

Problems to be Solved by the Invention

In the tape winder included in the known tape winding device, at the time of winding a tape, the object is drawn to the tape by a tape peeling force (adhesive force against the non-adhesive surface that is the back surface of the tape) and is displaced from the axis, and thus proper winding may not be able to be performed.

In the known tape winder, the object is pulled in the rotation direction by the peeling force of the rotating tape, so that the object may rotate and a twist may occur.

The present invention has been made in view of the above circumstances, and an object of the present invention is to provide a tape winder having excellent tape winding performance for a roll tape.

Means for Solving the Problems

In order to achieve the object described above, in the present invention, a roll tape is held by a tip end portion of an arm connected by a pivot shaft fixed to a rotating body, and an enlarged diameter curved surface portion is provided that comes into contact with the arm that pivots at a time of rotation. In an angle range in which the arm is in contact with the enlarged diameter curved surface portion, the arm is pushed in a rotation outward direction at the time of rotation such that the tape stretched from the roll tape to an object is wound around the object while being pulled out. In an angle range in which the arm is not in contact with the enlarged diameter curved surface portion, the tape previously pulled out from the roll tape is wound around the object while being wound up on the object. In the angle range in which the arm is not in contact with the enlarged diameter curved surface portion, the tape is wound around the object 9 without being pulled out from the roll tape 1. Therefore, a tensile force applied to the object 9 in the direction of the roll tape 1 is suppressed. By repeating this alternately, displacement of the object from the rotation axis is suppressed, and proper winding is performed.

Effects of the Invention

According to the present invention, it is possible to provide a tape winder having excellent winding performance for a roll tape and a tape winding device including the tape winder.

BRIEF DESCRIPTION OF THE DRAWINGS

FIG. 1(*b*) is a perspective view showing a back surface of a tape holder portion of the tape winder.

FIG. 3(*b*) is a schematic view showing an operation of winding up a tape on the object without pulling out the tape.

MODES FOR CARRYING OUT THE INVENTION

Figure 1:
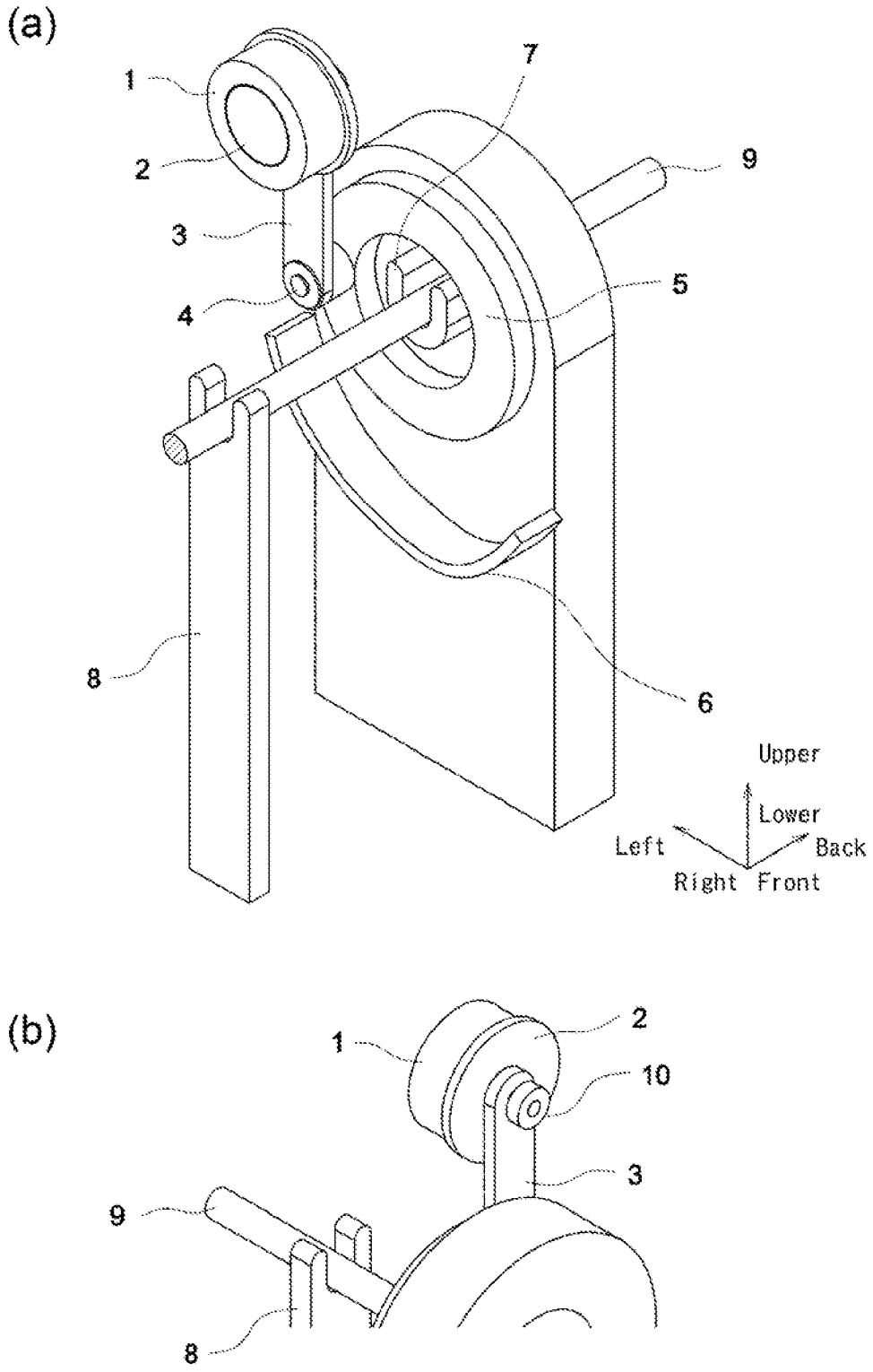
FIG. 1(*a*) is a perspective view of a tape winder according to the present invention.

As shown in FIG. 1, a holder portion 2 is provided at a tip end portion of an arm 3 connected by a pivot shaft 4 fixed to a rotating body 5 to hold a roll tape 1 (adhesive tape). A roller 10 is provided on the back surface of the holder portion 2 at the tip end of the arm 3, and an enlarged diameter curved surface portion that comes into contact with the roller 10 when the roll tape 1 rotates and passes under the object is provided. A first support portion 7 and a second support portion 8 are provided that support the object 9 so as to suppress the object 9 from displacing from the axis of the rotating body 5.

The pivot shaft 4 has such a holding force that the pivot shaft 4 does not pivot due to the weights of the roll tape 1, the holder portion 2, and the arm 3, and has a holding force within such a range that the arm 3 pivots without pulling out the tape from the roll tape 1 when the tape stretched from the roll tape 1 to the object 9 is wound up by the object 9.

Examples

Figure 2:
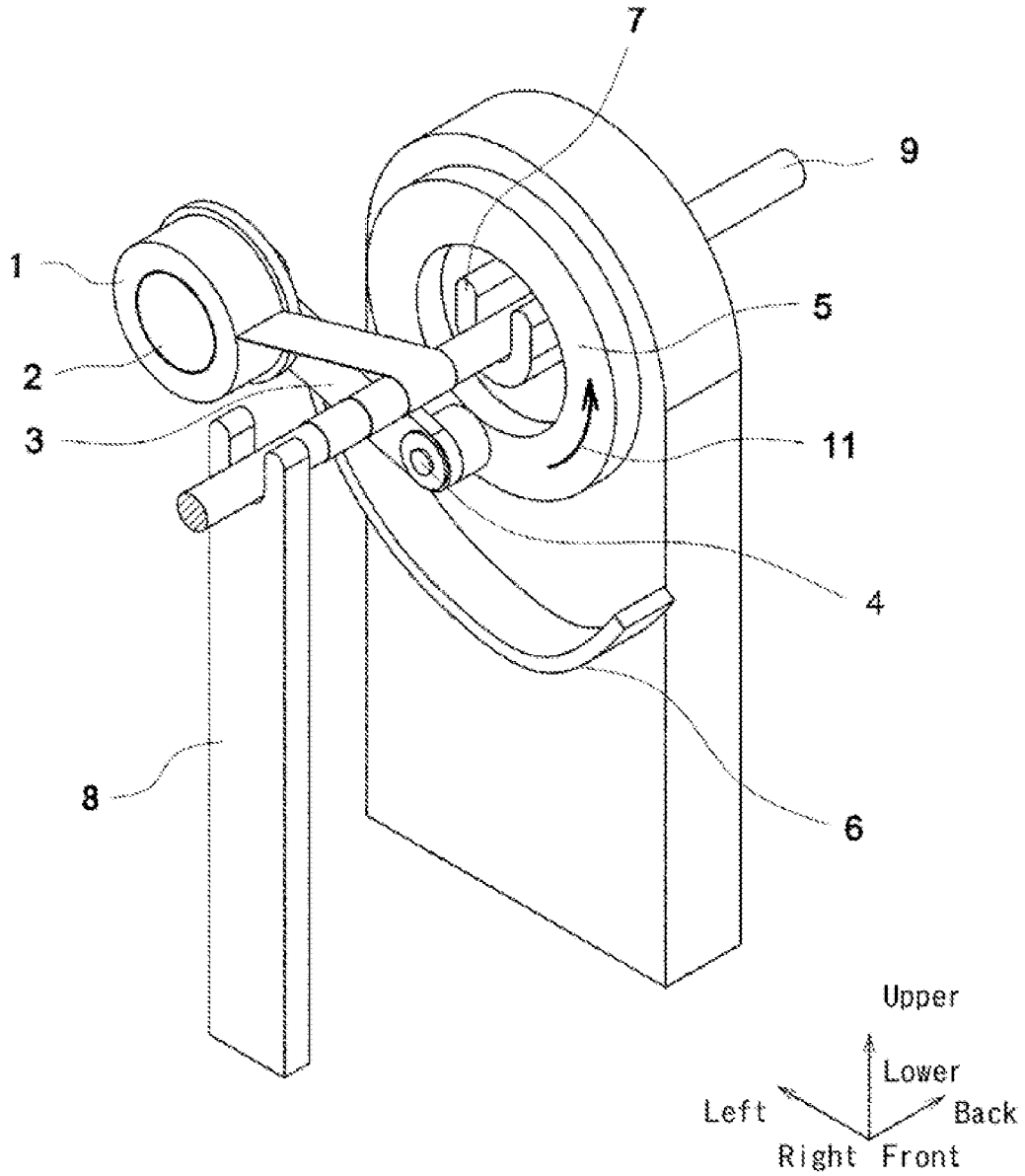
FIG. 2 is a perspective view showing a tape winding operation.
Figure 3:
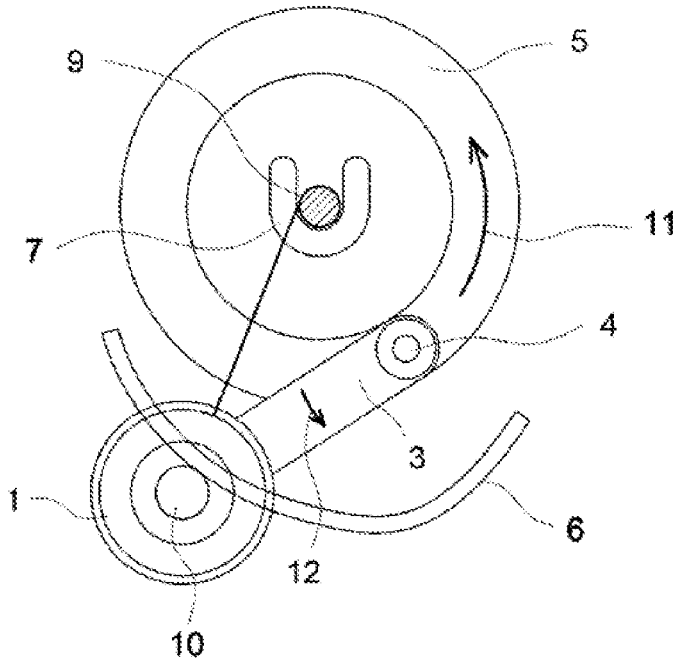
FIG. 3(*a*) is a schematic view showing an operation of winding a tape around an object while pulling out the tape.
Figure 3:
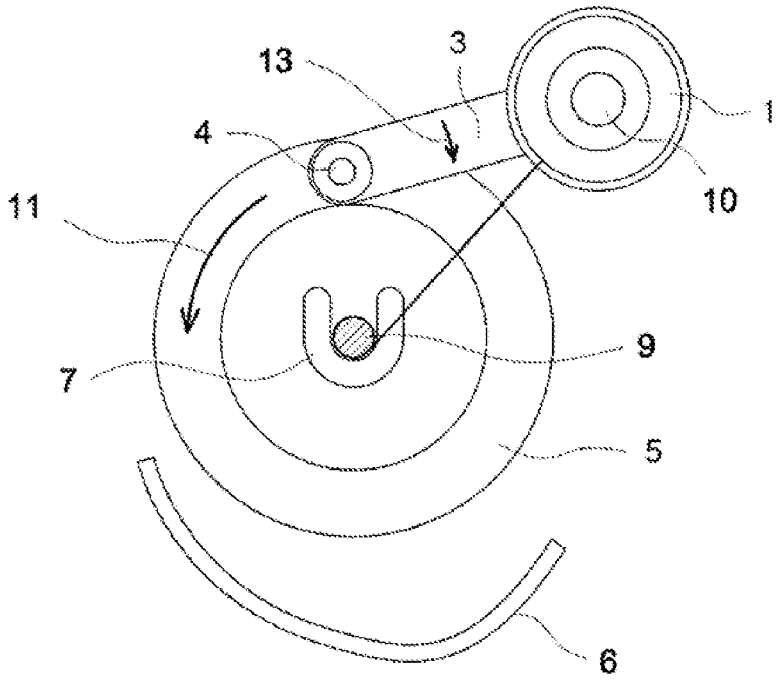

The operations of the tape winder will be described with reference to FIG. 2. FIG. 3 shows schematic views showing the rotating body 5 and the arm 3 performing a tape winding operation.

First, the object 9 (a bundle of electric wires or the like) held by an operator's hand or a device and extending on the axis of the rotating body 5 is supported by the first support portion 7 and the second support portion 8. At this time, it is preferable to bring the object 9 into contact with the deepest portion of the inner surface of the recess of each of the first support portion 7 and the second support portion 8.

A tape end portion of the roll tape 1 held by the tip end portion of the arm 3 connected to the rotating body 5 with the pivot shaft 4 is pulled out and attached to the object 9.

When the rotating body 5 starts rotating in the direction of a rotation direction 11 in response to the driving force from a driving device, the tape stretched from the roll tape 1 to the object 9 is wound up by the object 9, the arm 3 pivots, and the roll tape 1 comes close to the object 9 while rotating.

When the roll tape 1 rotates to a position below the object 9, the roller 10 provided on the back surface of the tape holder portion 2 comes into contact with the enlarged diameter curved surface portion 6.

As shown in FIG. 3(*a*), when the rotating body 5 rotates in the direction of the rotation direction 11 while the roller 10 is in contact with the enlarged diameter curved surface portion 6, the arm 3 is pushed in a rotation outward direction and the arm 3 pivots in a pivot direction (outward) 12, so that the tape is wound around the object 9 while being pulled out from the roll tape 1. At this time, a downward tensile force is applied to the object 9 in order to pull out the tape, but the object 9 is supported by the first support portion 7 and the second support portion 8 in the downward direction.

As shown in FIG. 3(*b*), in an angle range in which the roller 10 is not in contact with the enlarged diameter curved surface portion 6, the rotating body 5 rotates in the direction of the rotation direction 11 so that the tape stretched from the roll tape 1 to the object 9 is wound up by the object 9, whereby a tension is applied between the roll tape 1 and the object 9. Since the object 9 is supported by the first support portion 7 and the second support portion 8, the roll tape 1 is pulled in the direction of the object 9. The holding force of the pivot shaft 4 connecting the rotating body 5 and the arm 3 is smaller than the peeling force of the tape (adhesive force against the non-adhesive surface that is the back surface of the tape). Therefore, the arm 3 pivots around the pivot shaft 4 in the direction of the rotation direction (inward) 13 that is a direction in which the roll tape 1 comes close to the object 9, without pulling out the tape. When the roll tape 1 is brought close to the object 9 while the tape is being wound up by the object 9 from the roll tape 1, the tension applied to the tape stretched between the roll tape 1 and the object 9 is suppressed, so that the tensile force applied to the object 9 in the direction of the roll tape 1 is also suppressed.

The operation of winding the tape around the object 9 while pulling out the tape from the roll tape 1 and the operation of winding the tape that has been previously pulled out around the object 9 while winding up the tape on the object 9 without pulling out the tape from the roll tape 1 are alternately repeated, so that the displacement of the object from the rotation axis is suppressed and proper winding is performed.

The present invention is not limited to the above embodiments, and various modifications can be adopted within the scope of the present invention. In addition, materials, shapes, dimensions, locations, and the like of the components in the above embodiments can be set as appropriate and are not limited as long as the present invention can be achieved. This applies to the shape of the rotating body, the location and the shape of the support portion, for example.

Further, the winding position is not limited to one position for overlap winding, and it is possible to spirally wind the tape around the object by moving the tape winder and the object relative to each other along the rotation axis.

Further, the object around which the tape is wound is not limited to the bundle of electric wires, and in the present invention, any linear material around which the tape can be wound may be adopted. For example, the object may be a single electric wire, a linear member not including an electric wire, or a tube-shaped material.

DESCRIPTION OF REFERENCE SIGNS

1 roll tape
2 holder portion
3 arm
4 pivot shaft
5 rotating body
6 enlarged diameter curved surface portion
7 first support portion
8 second support portion
9 object
10 roller
11 rotation direction
12 pivot direction (outward)
13 pivot direction (inward)

I claim:

1. A tape winding device comprising, a roll tape is held by a tip end portion of an arm connected by a pivot shaft fixed to a rotating body, and an operation of winding a tape around an object while pulling out the tape from the roll tape and an operation of winding a tape that has been previously pulled out around the object while winding up the tape on the object are alternately repeated;

characterized in that an enlarged diameter curved surface portion is provided that comes into contact with the arm that pivots at a time of rotation, and the arm is pushed in a rotation outward direction at the time of rotation such that the tape stretched from the roll tape to the object is pulled out.

2. A tape winding device comprising:

a roll tape including:

a holder portion (2) is connected to an arm (3) and that is connected by a pivot shaft (4) fixed to a rotating body (5) to hold the roll tape (1);

a roller (10) is in connection with the holder portion (2);

a first support portion (7) and a second support portion (8) that provides support to an object (9) and avoids displacing the object (9); and an enlarged diameter curved surface portion (6) that comes into contact with the roller (10);

wherein, the roller (10) is in connection with the enlarged diameter curved surface portion (6), the rotating body (5) rotates in the direction of the rotation direction (11) so that the tape stretched from the roll tape (1) and is wound around the object (9), wherein, when the roller (10) is not in contact with enlarged diameter curved surface (6), the rotating body (5) rotates in the direction of the rotation direction (11) and the previously stretched tape is wound around the object (9).

3. The tape winding device according to claim 2, wherein a downward tensile force is applied to the object (9) in order to pull out the tape (1).

4. The tape winding device according to claim 2, wherein the pivot shaft (4) has a holding force that prevent the pivot shaft to move due to the weight of the roll tape (1).

5. The tape winding device according to claim 2, wherein the support portions (7, 8) suppress the object (9) when tape wound on the object (9).

6. The tape winding device according to claim 2, wherein the object (9) can be held by an operator's hand.

* * * * *